US009927732B2

(12) United States Patent
Otsubo

(10) Patent No.: US 9,927,732 B2
(45) Date of Patent: Mar. 27, 2018

(54) LIGHT SCANNING APPARATUS AND IMAGE FORMING APPARATUS

(71) Applicant: CANON KABUSHIKI KAISHA, Tokyo (JP)

(72) Inventor: Yoshitaka Otsubo, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/229,086

(22) Filed: Aug. 4, 2016

(65) Prior Publication Data

US 2017/0052474 A1 Feb. 23, 2017

(30) Foreign Application Priority Data

Aug. 19, 2015 (JP) ..... 2015-161970

(51) Int. Cl.
*G03G 15/04* (2006.01)
*G03G 21/16* (2006.01)

(52) U.S. Cl.
CPC . *G03G 15/04036* (2013.01); *G03G 15/04045* (2013.01); *G03G 21/1666* (2013.01)

(58) Field of Classification Search
CPC ..... G03G 21/1666; G03G 21/1832; G03G 2221/1648; G03G 15/04036
See application file for complete search history.

(56) References Cited

U.S. PATENT DOCUMENTS 7,830,545 B2 * 11/2010 Mamiya ..... B41J 2/471 347/241
8,928,719 B2 * 1/2015 Mogi ..... B41J 2/473 347/245
9,239,535 B2 * 1/2016 Iwai ..... G03G 15/0409
9,519,259 B2 * 12/2016 Yoshida ..... G03G 21/1619
2013/0135419 A1 * 5/2013 Otoguro ..... G03G 15/04036 347/224

FOREIGN PATENT DOCUMENTS

JP 2014-012368 1/2014

OTHER PUBLICATIONS

U.S. Appl. No. 15/226,410, filed Aug. 2, 2016.

* cited by examiner

*Primary Examiner* — Gregory H Curran
(74) *Attorney, Agent, or Firm* — Fitzpatrick, Cella, Harper & Scinto

(57) ABSTRACT

Provided is a light scanning apparatus, including: a light source; a rotary polygon mirror; an optical member guiding a light beam; an optical box on which the light source is mounted and which contains the rotary polygon mirror and the optical member; a cover covering an opening of the optical box; a fixation unit fixing the cover on the optical box; the cover having a dust-proof member which is sandwiched between the cover and a side wall of the optical box; and the dust-proof member including an abutment portion against which the side wall is brought into abutment, and non-abutment portions provided on both sides of the abutment portion and separated from the side wall, and the dust-proof member including a groove in one of the non-abutment portions which is located on a side opposite to another one located on a side where the fixation unit is provided.

11 Claims, 6 Drawing Sheets

LIGHT SCANNING APPARATUS AND IMAGE FORMING APPARATUS

BACKGROUND OF THE INVENTION

Field of the Invention

The present invention relates to a light scanning apparatus and an image forming apparatus including the light scanning apparatus.

Description of the Related Art

Hitherto, in an image forming apparatus employing an electrophotographic method, a photosensitive drum having a surface charged to a uniform electric potential is scanned with a light beam which is emitted from a light scanning apparatus based on image information, to thereby form an electrostatic latent image. The formed electrostatic latent image is developed by developer (toner) into a visible image, and the visible toner image is transferred onto a sheet. After that, the unfixed toner image is fixed on the sheet by a fixing unit, and the sheet is delivered. The light scanning apparatus configured to perform scanning with a light beam includes an optical system having a deflection device, which includes a rotary polygon mirror configured to deflect the light beam emitted from a semiconductor laser serving as a light emitting source, an optical lens (fθ lens), a reflecting mirror, and other components. In recent years, there has been an increasing demand for high-speed recording in the image forming apparatus, and hence higher scanning speed in the light scanning apparatus, that is, higher rotation speed of the rotary polygon mirror of the deflection device has been pursued continuously. When the rotary polygon mirror is rotated at high speed, a positive pressure region and a negative pressure region are generated on a mirror surface of the rotary polygon mirror, thereby causing adhesion of dirt, such as fine dust or mist in air, on the negative pressure region of the mirror surface. Such adhesion of dirt on the rotary polygon mirror reduces reflectivity at a portion with the adhesion of dirt. Therefore, the light intensity of a light beam, which is deflected by the rotary polygon mirror and output from the light scanning apparatus, is reduced. There has been a problem in that the reduced light intensity may cause failure in writing to a photosensitive drum as well as image degradation on the sheet onto which an image formed on the photosensitive drum is transferred.

To address this problem, a related-art light scanning apparatus secures sealability of the light scanning apparatus with the following configuration. Specifically, an opening formed on top of a housing having optical components mounted therein (hereinafter referred to as "optical box") is covered with a cover component (hereinafter referred to as "upper cover") configured to cover the opening, and a sealing part formed of a soft sealing member such as a foam member is sandwiched at a portion where the optical box and the upper cover are brought into abutment against each other. The upper cover and the optical box are snap-fitted or fastened with screws. With this, the sealing member of the sealing part is pressed, thereby securing the sealability of the light scanning apparatus.

In the case of this configuration, there may occur deformation of the upper cover due to a repulsion force of the pressed sealing member, and fatigue degradation of the sealing member due to continuous pressing. Thus, there is a problem in that the sealability of the light scanning apparatus is degraded along with deformation of the upper cover or fatigue degradation of the sealing member. For the purpose of preventing degradation in the degree of sealing of the optical box, there has been proposed a measure to reduce deformation of the upper cover and fatigue degradation of the sealing member to a maximum extent.

For example, in Japanese Patent Application Laid-Open No. 2014-12368, there is proposed an optical box including a plurality of fixing seats for allowing an upper cover to be fastened thereon with screws. In this optical box, the fixing seats onto which the upper cover is screwed include high fixing seats and low fixing seats. When use is started, the high fixing seats and the upper cover are fastened with screws. The fixing seats are removable. When the sealing member is degraded by fatigue, the upper cover is reassembled, and the high fixing seats having been used so far are removed. Then, the upper cover is screwed onto the low fixing seats, thereby being capable of fastening the upper cover even under a state in which the sealing member is degraded by fatigue. Removing the high fixing seats and screwing the upper cover onto the low fixing seats can suppress deformation of the upper cover due to a repulsion force from the fixing seats.

In the method described above, there is a problem in that the dust-proof performance may be degraded due to a gap formed between the sealing member and the upper cover along with deformation of the upper cover which may occur from an initial period of use rather than over time, and due to separation of the sealing member caused by the deformation of the upper cover.

SUMMARY OF THE INVENTION

The present invention has been made under such circumstances, and it is an object of the present invention to prevent degradation in the degree of sealing of an optical box due to deformation of an upper cover with a simple configuration.

In order to solve the above-mentioned problems, the present invention has the following configurations.

(1) A light scanning apparatus, including: a light source configured to emit a light beam; a rotary polygon mirror configured to deflect the light beam emitted from the light source so as to scan a photosensitive member with the light beam; an optical member configured to guide the light beam deflected by the rotary polygon mirror to the photosensitive member; an optical box on which the light source is mounted and configured to contain the rotary polygon mirror and the optical member; a cover configured to cover an opening of the optical box; a fixation unit configured to fix the cover on the optical box; the cover having a dust-proof member which is molded on the cover so as to prevent dust from entering into the optical box and which is sandwiched between the cover fixed on the optical box by the fixation unit and a side wall of the optical box; and the dust-proof member including an abutment portion against which the side wall is brought into abutment, and non-abutment portions which are provided on both sides of the abutment portion in a transverse direction of the abutment portion and which are separated from the side wall, and the dust-proof member including a groove in one of the non-abutment portions, which is located on a side opposite to another one of the non-abutment portions located on a side where the fixation unit is provided, with respect to the abutment portion against which the side wall is brought into abutment.

(2) An image forming apparatus, including: a photosensitive member; the light scanning apparatus described in Item (1), which is configured to radiate a light beam onto the photosensitive member to form an electrostatic latent image on the photosensitive member; a developing unit configured to develop the electrostatic latent image formed by the light scanning apparatus to form a toner image; and a transfer unit configured to transfer the toner image formed by the developing unit onto a recording medium.

According to the present invention, degradation in the degree of sealing of the optical box due to deformation of the upper cover can be prevented with a simple configuration.

Further features of the present invention will become apparent from the following description of exemplary embodiments with reference to the attached drawings.

DESCRIPTION OF THE EMBODIMENTS

Embodiments of the present invention are described in detail below with reference to the attached drawings.

Embodiment

Overview of Image Forming Apparatus

Figure 1:
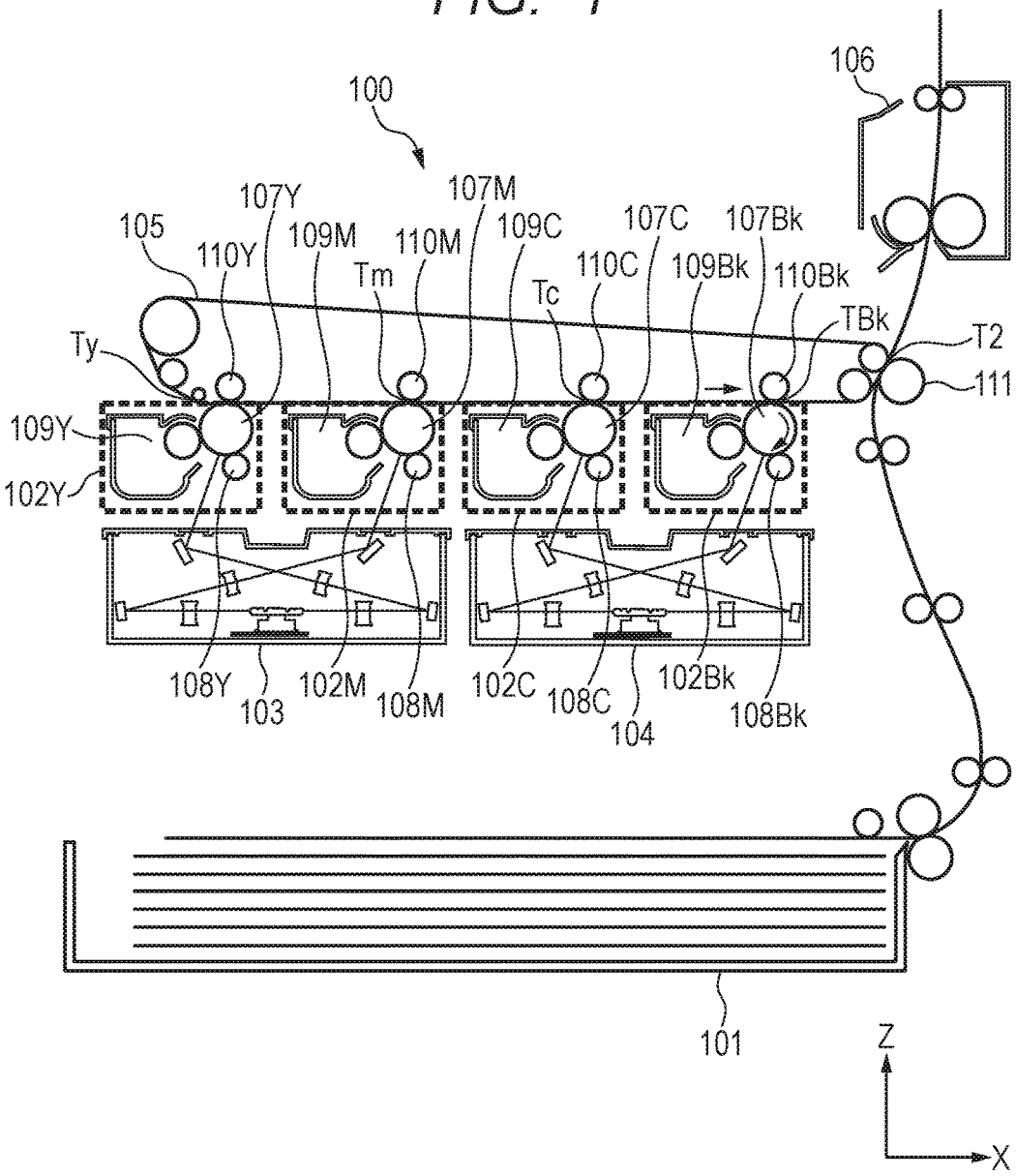
FIG. 1 is a schematic sectional view for illustrating a configuration of an image forming apparatus according to an embodiment of the present invention.

FIG. 1 is a schematic sectional view of an electrophotographic image forming apparatus 100 according to the embodiment. The image forming apparatus 100 of FIG. 1 includes a sheet-feeding unit 101, image forming units 102Y, 102M, 102C, and 102Bk, light scanning apparatus 103 and 104, an intermediate transfer belt 105, and a fixing device 106. The sheet-feeding unit 101 is configured to feed a sheet (also referred to as a recording sheet) and convey the sheet to a secondary transfer portion T2. The light scanning apparatus 103 is configured to radiate light beams to photosensitive drums 107Y and 107M in the image forming units 102Y and 102M to form electrostatic latent images on the photosensitive drums, respectively. The light scanning apparatus 104 is configured to scan photosensitive drums 107C and 107Bk in the image forming units 102C and 102Bk to form electrostatic latent images on the photosensitive drums, respectively. The image forming units 102Y, 102M, 102C, and 102Bk are configured to form toner images of yellow (Y), magenta (M), cyan (C), and black (Bk) on the photosensitive drums 107Y, 107M, 107C, and 107Bk, respectively. In the following, the reference symbols Y, M, C, and Bk representing colors of toner are omitted unless otherwise needed. The toner images formed on the photosensitive drums 107 of the respective image forming units 102 are transferred onto the intermediate transfer belt 105. At the secondary transfer portion T2, the toner images on the intermediate transfer belt 105 are collectively transferred onto the recording sheet fed from the sheet-feeding unit 101. The fixing device 106 is configured to fix the unfixed toner images, which have been transferred onto the recording sheet, on the recording sheet.

Components of the image forming units 102Y, 102M, 102C, and 102Bk of the image forming apparatus 100 according to this embodiment are the same, and hence description is hereinafter made using the image forming unit 102Y. In the following description, a direction of a rotation axis of a rotary polygon mirror 205 is referred to as a Z axis direction. A main scanning direction as a scanning direction of the light beam or a longitudinal direction of a reflecting mirror is referred to as a Y axis direction. A direction which is perpendicular to both the Y axis and the Z axis is referred to as an X axis direction.

The image forming unit 102Y includes the photosensitive drum 107Y serving as a photosensitive member, a charging device 108Y, and a developing device 109Y. When an image is formed, the charging device 108Y charges a surface of the photosensitive drum 107Y to a uniform electric potential. The charged surface of the photosensitive drum 107Y is exposed with light by the light scanning apparatus 103, thereby forming an electrostatic latent image. This electrostatic latent image is formed into a visible image (developed) with yellow toner supplied by the developing device 109Y, thereby forming a toner image. At a primary transfer portion Ty, a primary transfer roller 110Y is arranged so as to be opposed to the photosensitive drum 107Y. A predetermined transfer voltage is applied to the primary transfer roller 110Y so that the toner image formed on the photosensitive drum 107Y (on the photosensitive member) is transferred onto the intermediate transfer belt 105. Similarly, toner images of other colors on the photosensitive drums 107M, 107C, and 107Bk are also transferred onto the intermediate transfer belt 105 by primary transfer rollers 110M, 110C, and 110Bk arranged at primary transfer portions Tm, Tc, and TBk.

At the secondary transfer portion T2, a secondary transfer roller 111 is arranged so as to be opposed to the intermediate transfer belt 105. A predetermined transfer voltage is applied to the secondary transfer roller 111 so that the toner images on the intermediate transfer belt 105 are transferred onto the recording sheet, which is a recording medium conveyed from the sheet-feeding unit 101. The recording sheet bearing the transferred toner images is conveyed to the fixing device 106, and the unfixed toner images are heated to be fixed on the recording sheet by the fixing device 106. The recording sheet after having been subjected to the fixing by the fixing device 106 is delivered to a sheet delivery unit (not shown).

[Light Paths of Light Scanning Apparatus]

Next, the light scanning apparatus 103 and 104 are described. The image forming apparatus according to this embodiment includes the light scanning apparatus 103, which is configured to expose the photosensitive drums 107Y and 107M with light, and the light scanning apparatus 104, which is configured to expose the photosensitive drums 107C and 107Bk with light. The light scanning apparatus 103 and 104 have the same configuration as illustrated in FIG. 1. Therefore, description is hereinafter made using the light scanning apparatus 103.

Figure 2A:
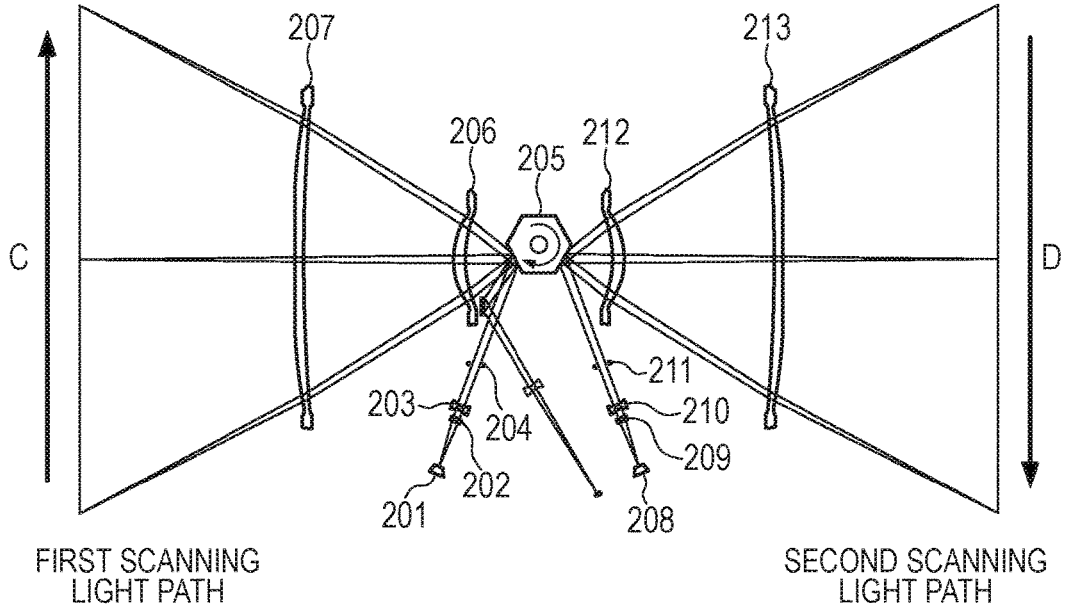
FIG. 2A is a main scanning sectional view of a light scanning apparatus according to the embodiment of the present invention.

FIG. 2A is a main scanning sectional view for illustrating light paths of the light scanning apparatus 103 configured to expose the photosensitive drums 107Y and 107M with light, and the light paths are illustrated as extending on a plane. A scanning direction of laser light through rotation of the rotary polygon mirror 205 is referred to as a main scanning direction. A direction which is orthogonal to the main scanning direction and perpendicular to the rotation axis of the rotary polygon mirror 205 is referred to as a sub-scanning direction. The main scanning section is a plane which is parallel to the scanning direction of the laser light and perpendicular to the rotation axis of the rotary polygon mirror 205 (plane having the rotation axis of the rotary polygon mirror as a normal line).

As illustrated in FIG. 2A, the rotary polygon mirror 205 is configured to deflect laser light emitted from a light source 201 leftward in FIG. 2A, and deflect laser light emitted from a light source 208 rightward in FIG. 2A. As a result, the laser light emitted from the light source 201 scans in a direction of the arrow C (first scanning light path), and the laser light emitted from the light source 208 scans in a direction of the arrow D (second scanning light path).

On the first scanning light path, the laser light (light beam) emitted from the light source 201 is transformed into parallel light by a collimator lens 202. The laser light is converged only in the sub-scanning direction by a cylindrical lens 203 arranged immediately after the collimator lens 202. The laser light converged only in the sub-scanning direction is shaped by a diaphragm 204 into a predetermined shape and thereafter formed into a linear image on a reflection surface of the rotary polygon mirror 205. The laser light formed into the image on the reflection surface of the rotary polygon mirror 205 is transformed into scanning light toward the photosensitive drum 107 through rotation of the rotary polygon mirror 205 in a direction of the arrow (clockwise direction) in FIG. 2A. The surface of the photosensitive drum 107 is scanned with the transformed laser light at constant speed through fθ lenses 206 and 207 serving as optical members.

On the second scanning light path, the laser light (light beam) emitted from the light source 208 is transformed into parallel light by a collimator lens 209. The laser light is converged only in the sub-scanning direction by a cylindrical lens 210 arranged immediately after the collimator lens 209. The laser light converged only in the sub-scanning direction is shaped by a diaphragm 211 into a predetermined shape and thereafter formed into a linear image on the reflection surface of the rotary polygon mirror 205. The laser light formed into the image on the reflection surface of the rotary polygon mirror 205 is transformed into scanning light toward the photosensitive drum 107 through rotation of the rotary polygon mirror 205. The surface of the photosensitive drum 107 is scanned with the transformed laser light at constant speed through fθ lenses 212 and 213 serving as optical members.

[Configuration of Light Scanning Apparatus]

Figure 2B:
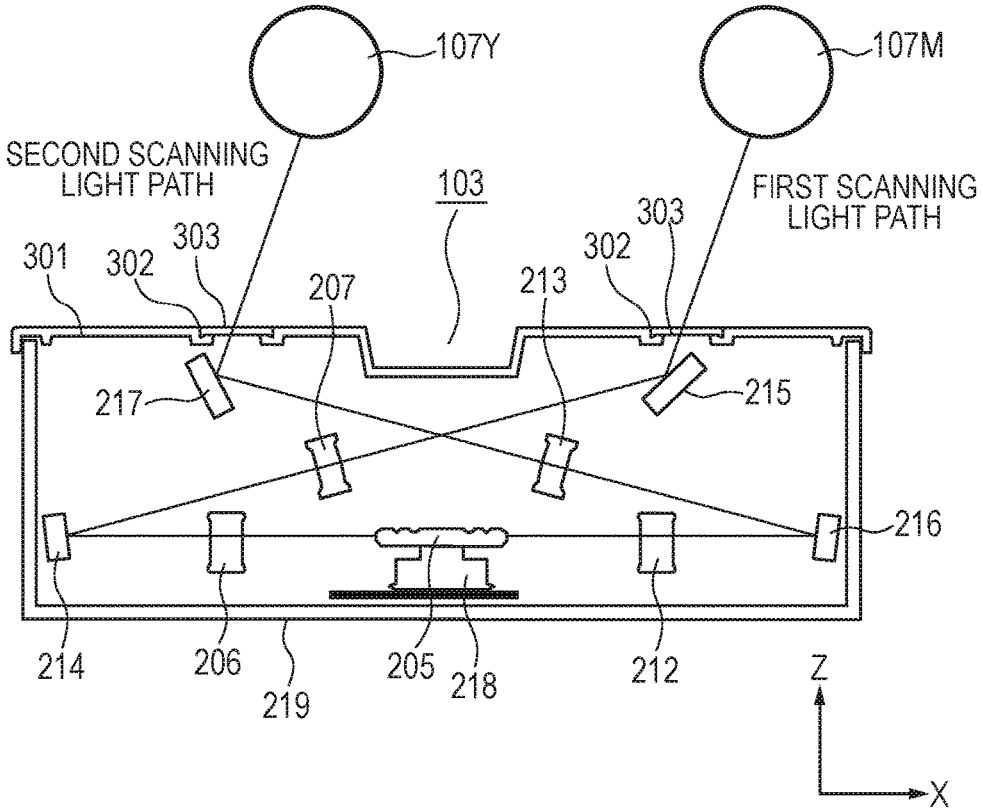
FIG. 2B is a sectional view for illustrating a configuration of the light scanning apparatus according to the embodiment of the present invention.

FIG. 2B is a sectional view for illustrating a configuration of the light scanning apparatus 103, which is configured to scan the photosensitive drums 107Y and 107M, described with reference to FIG. 2A. In FIG. 2A, the main scanning sectional view, in which the light paths of the laser light passing through an optical system including the lenses and reflecting mirrors (not shown in FIG. 2A) are developed in a plane, is described. In an actual light scanning apparatus, three-dimensional light paths are formed using the reflecting mirrors as illustrated in FIG. 2B. In FIG. 2B, the laser light emitted from the light source 201 is deflected by the rotary polygon mirror 205. The deflected laser light is reflected by a reflecting mirror 214, which is an optical member, after having passed through the fθ lens 206, and then is guided to the fθ lens 207. The laser light having passed through the fθ lens 207 is reflected by the reflecting mirror 215 and guided to the photosensitive drum 107M.

The laser light emitted from the light source 208 is deflected by the rotary polygon mirror 205. The deflected laser light is reflected by the reflecting mirror 216 after having passed through the fθ lens 212, and then is guided to the fθ lens 213. The laser light having passed through the fθ lens 213 is reflected by the reflecting mirror 217 and guided to the photosensitive drum 107Y. The rotary polygon mirror 205 is supported by a drive motor 218 and rotationally driven by the drive motor 218. In this embodiment, the rotary polygon mirror 205 and the drive motor 218 integrally construct a deflection unit.

As illustrated in FIG. 2B, the fθ lenses 206, 207, 212, and 213, the reflecting mirrors 214, 215, 216, and 217, the rotary polygon mirror 205, and the drive motor 218, which are optical components, are contained in an optical box 219, which is a housing, to construct the light scanning apparatus 103. The optical box 219 is often formed of material which is obtained by mixing synthetic resin, such as polycarbonate or polystyrene, with glass fiber for reinforcement. On an opening formed on top of the optical box 219 of FIG. 2B, an upper cover 301 is mounted so as to prevent dust from entering into the optical box 219. The upper cover 301 has openings for passage of the laser light to be guided to the photosensitive drums 107Y and 107M. For the purpose of preventing dust from entering into the optical box 219 through the openings, dust-proof glasses 303 are arranged over the openings on a side opposed to the photosensitive drums 107. The dust-proof glasses 303 are attached to the upper cover 301 by double-sided tapes 302.

[Appearance of Light Scanning Apparatus]

Figure 3A:
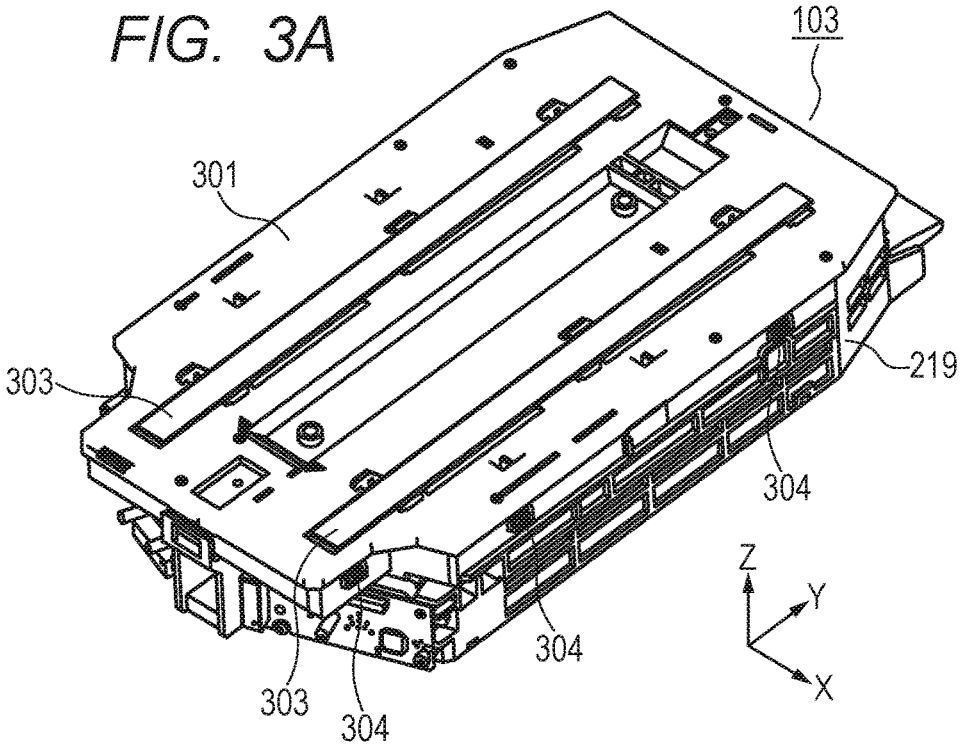
FIG. 3A is a perspective view for illustrating a state in which an upper cover of the light scanning apparatus is mounted according to the embodiment of the present invention.
Figure 3B:
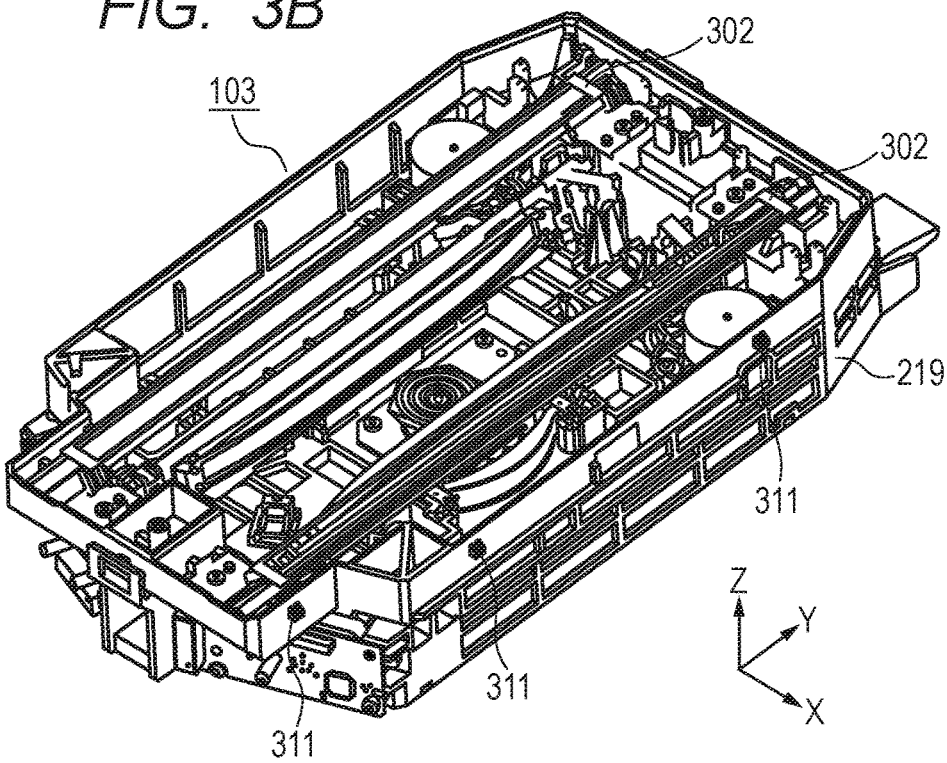
FIG. 3B is a perspective view for illustrating a state in which the upper cover of the light scanning apparatus is removed according to the embodiment of the present invention.

FIG. 3A and FIG. 3B are perspective views for illustrating an appearance of the light scanning apparatus 103. FIG. 3A is a perspective view for illustrating the appearance of the light scanning apparatus 103 under a state in which the upper cover 301 is mounted on the optical box 219. FIG. 3B is a perspective view for illustrating an internal configuration of the light scanning apparatus 103 under a state in which the upper cover 301 is removed. The dust-proof glasses 303 attached to the upper cover 301 by the frame-like double-sided tapes 302 (FIG. 3B) are provided on a side of the upper cover 301 opposed to the photosensitive drums 107. The laser light passes through the dust-proof glasses 303 toward the photosensitive drums 107. Each of the double-sided tapes 302 is provided in a frame-like form along an outer peripheral portion of the dust-proof glass 303 in order to attach the dust-proof glass 303 to the upper cover 301. The double-sided tapes 302 are hidden by the dust-proof glasses 303 in FIG. 3A. Thus, the double-sided tapes 302 are illustrated in FIG. 3B to clearly indicate the positions of the double-sided tapes 302. On an outer periphery of the upper cover 301, there are arranged a plurality of snap-fit parts 304 (FIG. 3A) which are engagement claws. Projections 311

(FIG. 3B), which are provided at positions corresponding to the snap-fit parts 304 of the optical box 219, are brought into engagement with the snap-fit parts 304, thereby being capable of mounting the upper cover 301 on the optical box 219.

[Overview of Sealing Part]

Figure 4:
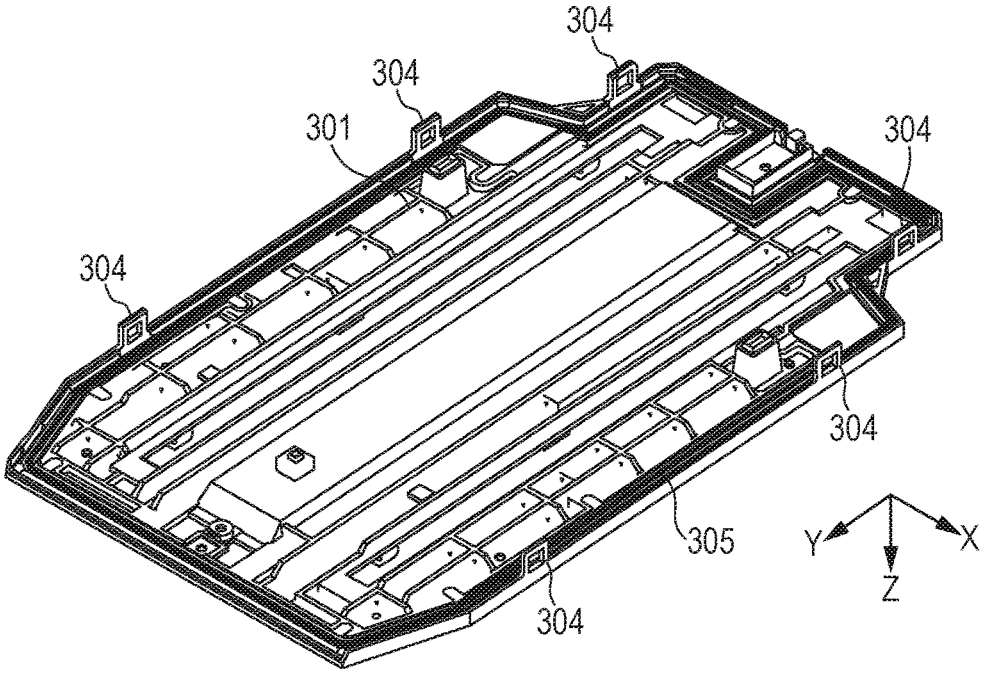
FIG. 4 is a perspective view for illustrating a back surface of the upper cover according to the embodiment of the present invention.

FIG. 4 is a perspective view for illustrating a back surface of the upper cover 301, that is, a surface of the upper cover 301 on a side opposed to the optical box 219 when the upper cover 301 is mounted on the optical box 219. On the back surface of the upper cover 301, there is provided a sealing part 305 (thick and black portion in FIG. 4) entirely on a peripheral portion to be brought into abutment against a side wall, which forms an outer peripheral edge of the optical box 219, when the upper cover 301 is mounted on the optical box 219. The sealing part 305 is formed on the upper cover 301 so as to be integrated with the upper cover 301 by injecting a hot-melt adhesive, which is an elastic member, into a space between the upper cover 301 and a mold held in abutment against the upper cover 301. The snap-fit parts 304 provided on the upper cover 301 are brought into engagement with the projections 311 (FIG. 3B) provided on outer wall surfaces of the side wall of the optical box 219 so that the upper cover 301 is mounted on the optical box 219. The sealing part 305, which is a dust-proof member, is sandwiched between the optical box 219 and the upper cover 301. With this, inside and outside of the optical box 219 are isolated to seal the optical box 219 with the sealing part 305, thereby preventing dust from entering into the optical box 219.

[Shape of Sealing Part]

Figure 5:
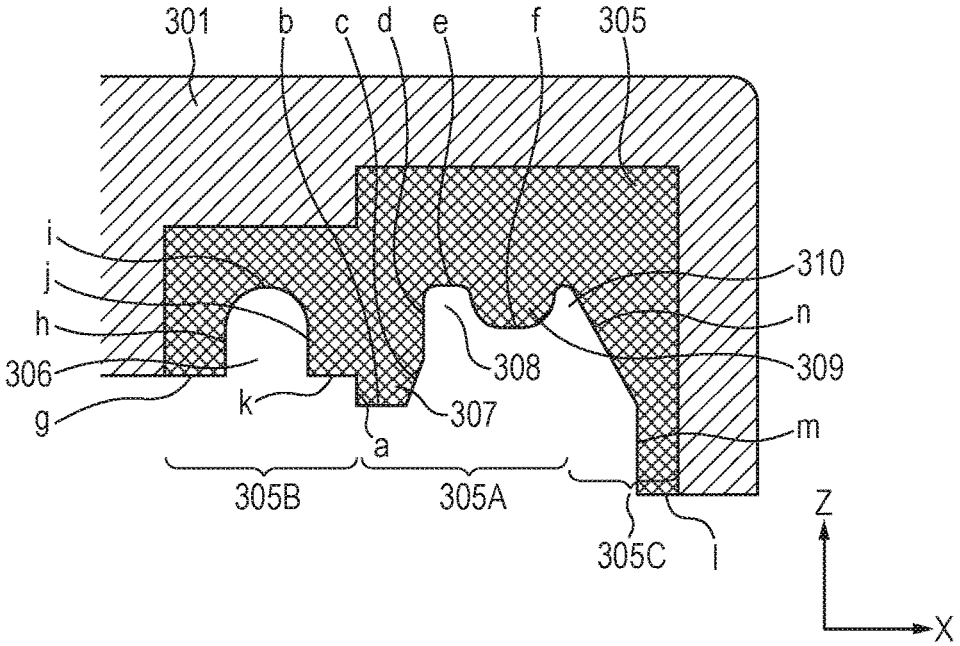
FIG. 5 is a sectional view for illustrating a shape of a sealing part according to the embodiment of the present invention.

FIG. 5 is a schematic sectional view for illustrating a sectional shape taken along a transverse direction of the sealing part 305 provided on the upper cover 301. In FIG. 5, the upper side corresponds to a front surface side of the upper cover 301, and the lower side corresponds to the back surface side of the upper cover 301, which is opposed to the optical box 219 when the upper cover 301 is mounted on the optical box 219. Further, in FIG. 5, the right side corresponds to an outer side of the optical box 219 when the upper cover 301 is mounted on the optical box 219. Further, in FIG. 5, the left side corresponds to an inner side of the optical box 219 when the upper cover 301 is mounted on the optical box 219, that is, a side on which the rotary polygon mirror 205 and the optical members are contained.

The sealing part 305 includes a sealing portion 305A, which is an abutment portion to be brought into abutment against the side wall of the optical box 219 and pressed when the upper cover 301 is mounted on the optical box 219, and sealing portions 305B and 305C, which are non-abutment portions located on both sides of the sealing portion 305A and prevented from being brought into abutment against the optical box 219 (separated from the optical box 219). The sealing portion 305B is a sealing portion which is adjacent to the sealing portion 305A and located on an inner side of the optical box 219 with respect to the sealing portion 305A, and has a groove 306 separated from the optical box 219. The sealing portion 305C is adjacent to the sealing portion 305A and located on an outer side of the optical box 219, which is a side opposite to the sealing portion 305B across the sealing portion 305A.

(Sealing Portion 305A)

The sealing portion 305A includes convex-shaped portions 307 and 309, which are convex portions having a convex shape and being protruded toward the optical box 219 (in a −Z axis direction), and concave-shaped portions 308 and 310, which are concave portions having a concave shape and being opposed to the optical box 219. The concave-shaped portion 308 is located between the convex-shaped portion 307 and the convex-shaped portion 309, and the concave-shaped portion 310 is located between the convex-shaped portion 309 and the sealing portion 305C. When the sealing portion 305A is viewed from the optical box 219, the sealing portion 305A has an opening formed by the convex-shaped portions 307 and the sealing portion 305C, and grooves formed in the opening by the concave-shaped portions 308 and 310 are partitioned by the convex-shaped portion 309.

The convex-shaped portion 307 is located at an end of the sealing portion 305A, which is connected to the sealing portion 305B, and has three surfaces a, b, and c. When the upper cover 301 is mounted on the optical box 219, the surface a forms a standing wall portion, which stands toward the optical box 219, and is connected to the adjacent surface b and a surface k of the sealing portion 305B. The surface b adjacent to the surface a is a flat surface which extends in the X axis direction, and is connected to the adjacent surface c. The surface c adjacent to the surface b is inclined with respect to a +Z axis direction and in a +X axis direction, and is connected to an adjacent surface d of the concave-shaped portion 308.

The convex-shaped portion 309 is located in the +X axis direction from a center of the sealing portion 305A, that is, close to the sealing portion 305C, and has a surface f which is a convex portion having a semicircular sectional shape and being protruded toward the optical box 219. One end of the surface f is adjacent (connected) to the concave-shaped portion 310, and another end of the surface f is adjacent (connected) to a surface e of the concave-shaped portion 308. A height of the convex-shaped portion 309 (height in the −Z axis direction (direction toward the optical box) from a bottom surface of the sealing part 305 on the upper cover 301 side) is lower than a height of the surface b of the convex-shaped portion 307 (height in the −Z direction from the bottom surface of the sealing part 305 on the upper cover 301 side).

The concave-shaped portion 308 is located between the convex-shaped portion 307 and the convex-shaped portion 309 and has two surfaces d and e. The surface d forms a standing wall portion, which stands toward the optical box 219 when the upper cover 301 is mounted on the optical box 219. One end of the surface d is connected to the surface c of the convex-shaped portion 307, and another end of the surface d is connected to the adjacent surface e. The surface e adjacent to the surface d is a flat surface extending in the X axis direction (also a bottom surface of the concave-shaped portion 308), and is connected to the adjacent convex-shaped portion 309.

The concave-shaped portion 310 is located between the convex-shaped portion 309 and the sealing portion 305C. One end of the concave-shaped portion 310 is connected to the surface f of the convex-shaped portion 309, and another end of the concave-shaped portion 310 is connected to an adjacent surface n of the sealing portion 305C.

(Sealing Portion 305B)

The sealing portion 305B has a surface g, the groove 306, and the surface k. The surface g is a flat surface extending in the X axis direction, which is formed to have a shape of continuing from a bottom surface of the upper cover 301 opposed to the optical box 219. The groove 306 has three surfaces h, i, and j. The surface h is adjacent to the surface g and forms a standing wall portion, which stands toward the optical box 219. One end of the surface h is connected to the surface g, and another end of the surface h is connected to the surface i. The surface i forms a convex portion having a semicircular sectional shape recessed away from the optical box 219. One end of the surface i is adjacent (connected) to the surface h, and another end of the surface i is adjacent (connected) to the surface j. The surface j is adjacent to the surface k and forms a standing wall portion, which stands toward the optical box 219. One end of the surface j is connected to the surface k, and another end of the surface j is connected to the surface i. The surface k is a flat surface extending in the X axis direction, which is formed to have a shape such as an extension of the surface g through intermediation of the groove 306. One end of the surface k is connected to the surface j of the groove 306, and another end of the surface k is connected to the surface a of the convex-shaped portion 307 of the sealing portion 305A.

A width (length in the transverse direction) of the groove 306 represents a distance of the opening of the groove 306, that is, a distance between the surface h and the surface j of the groove 306. A depth of the groove 306 represents a distance of the opening of the groove 306 to the deepest portion, that is, a distance from the surface g or k of the sealing portion 305B to the deepest portion of the surface i of the groove 306.

(Sealing Portion 305C)

The sealing portion 305C has surfaces 1, m, and n. The surface 1 is a flat surface extending in the X axis direction, which has a shape such as an extension of a flat surface at an end of the upper cover 301 opposed to the optical box 219 and is formed at an end of the sealing portion 305C on an outer side of the optical box 219. The surface m is adjacent to the surface 1 and forms a standing wall portion, which stands toward the optical box 219 when the upper cover 301 is mounted on the optical box 219. One end of the surface m is connected to the surface 1, and another end of the surface m is connected to the surface n. The surface n is inclined with respect to the +Z axis direction and in the −X axis direction. One end of the surface n is connected to the surface m, and another end of the surface n is connected to the adjacent concave-shaped portion 310 of the sealing portion 305A. A height of the surface 1 of the sealing portion 305C (height in the −Z axis direction (direction toward the optical box) from the bottom surface of the sealing part 305 on the upper cover 301 side) is higher than a height of the surface b of the convex-shaped portion 307 in the sealing portion 305A (height in the −Z axis direction from the bottom surface of the sealing part 305 on the upper cover 301 side).

[State of Sealing Part when Upper Cover is Mounted on Optical Box]

Figure 6:
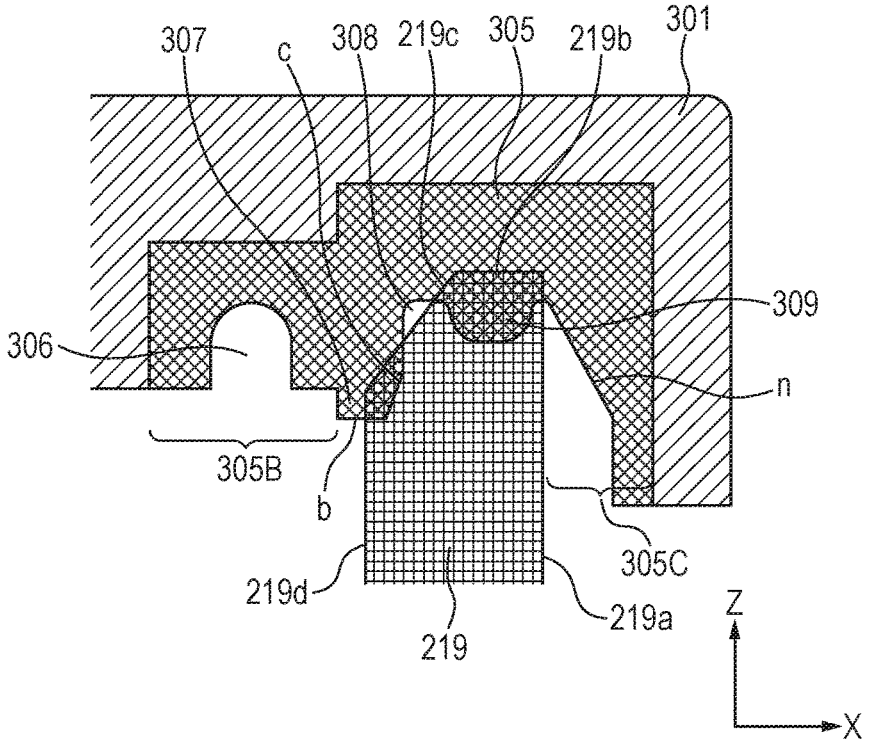
FIG. 6 is a sectional view for illustrating a state in which an optical box and the sealing part are brought into abutment against each other when the upper cover is mounted according to the embodiment of the present invention.

FIG. 6 is a schematic view for illustrating a section of the sealing part 305 taken along the transverse direction under a state in which the sealing part 305 provided on the upper cover 301 and surfaces 219*b* and 219*c* of the side wall, which forms the outer peripheral edge of the optical box 219, are brought into abutment against (contact with) each other when the upper cover 301 is mounted on the optical box 219. As illustrated in FIG. 6, the optical box 219 has four surfaces 219*a*, 219*b*, 219*c*, and 219*d*. The surface 219*a* is a wall surface which faces an outer side of the optical box 219. The surface 219*b* is a top surface which is adjacent to the surface 219*a* and is a distal end of the outer peripheral edge of the optical box 219 opposed to the upper cover 301. The surface 219*c* is a surface which is adjacent to the surface 219*b* and inclined with respect to the −X axis direction and in the −Z axis direction (surface which is downwardly inclined in the inward direction of the optical box 219). The surface 219*d* is adjacent to the surface 219*c* and faces the inner side of the optical box 219.

As illustrated in FIG. 6, the convex-shaped portions 309 and 307 of the sealing portion 305A are brought into abutment against the surfaces 219*b* and 219*c* of the optical box 219, respectively. The concave-shaped portion 308 formed between the convex-shaped portion 309 and the convex-shaped portion 307 is not brought into abutment against (contact with) the surfaces 219*b* and 219*c* of the optical box 219. The concave-shaped portion 308, the convex-shaped portions 307 and 309, and the surface 219*c* of the optical box 219 form a sealed portion (closed portion or closed space). When the upper cover 301 is mounted on the optical box 219, the surface 219*b* of the optical box 219 is guided along the inclination of the surface n, which is the inclined surface of the sealing portion 305C, in the +Z axis direction, that is, toward the convex-shaped portion 309 of the sealing portion 305A. As a result, the surface 219*b* of the optical box 219 is brought into abutment against the convex-shaped portion 309, and the convex-shaped portion 309 is pressed in the +Z direction by the surface 219*b* of the optical box 219 and elastically deformed. The surface 219*c* of the optical box 219 is brought into abutment against the surfaces b and c of the convex-shaped portion 307 of the sealing portion 305A, and the surfaces b and c of the convex-shaped portion 307 are pressed in the +Z axis direction and in the −X axis direction and elastically deformed. Then, the sealing part 305 and the side wall of the optical box 219 are brought into the state of being held in abutment against each other as illustrated in FIG. 6, that is, the state in which the surfaces 219*b* and 219*c* of the optical box 219 bite into the sealing part 305 so that the convex-shaped portions 309 and 307 of the sealing portion 305A are elastically deformed. As a result, the closed space is formed by the surface 219*c* of the optical box 219, the convex-shaped portions 307 and 309, and the concave-shaped portion 308.

When the upper cover 301 is mounted on the optical box 219, the convex-shaped portions 307 and 309 of the sealing portion 305A are brought into press contact with the surfaces 219*b* and 219*c* of the optical box 219. With this, a repulsion force is generated in the sealing portion 305A. The generated repulsion force is exerted in the X axis direction and in the Z axis direction. However, when the upper cover 301 is deformed due to the repulsion force exerted in the Z axis direction, a gap is formed between the upper cover 301 and the optical box 219, thereby affecting the dust-proof performance. In this embodiment, the groove 306 formed in the sealing portion 305B adjacent to the sealing portion 305A works to allow a part of the sealing portion 305A to be relieved toward the groove 306 by a volume corresponding to the amount of compression due to elastic deformation of the sealing portion 305A in the X axis direction (hereinafter referred to as "volume relief"). As a result, the repulsion force is dissipated, and hence the repulsion force exerted in the Z axis direction is transformed into the repulsion force in the X axis direction. The groove 306 eliminates formation of the gap between the optical box 219 and the upper cover 301 due to the deformation of the upper cover 301, thereby being capable of preventing degradation in the degree of sealing and degradation in the dust-proof performance of the optical box 219.

[Difference in Repulsion Force in Accordance with Shapes of Sealing Part]

Figure 7:
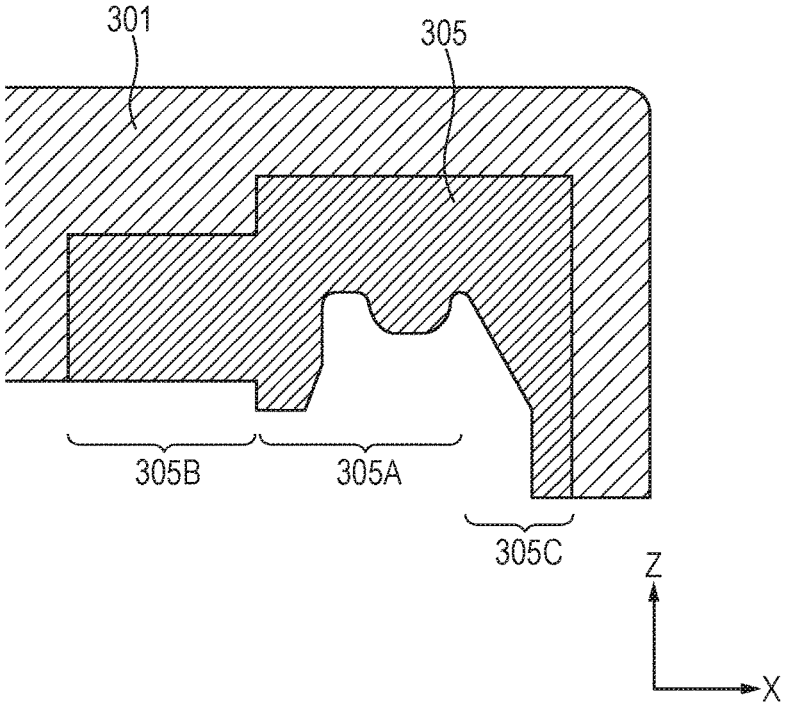
FIG. 7 is a sectional view for illustrating a shape of the sealing part with absence of a groove according to the embodiment of the present invention.

The sealing part 305 having the groove 306 according to this embodiment is described with reference to FIG. 5. FIG. 7 is a schematic sectional view for illustrating a sectional shape of the sealing part 305, which does not have the groove 306 described with reference to FIG. 5, in the transverse direction. In FIG. 7, the shapes of the sealing portions 305A and 305C are the same as those of FIG. 5, but there is a difference from FIG. 5 in that the groove 306 is not formed in the sealing portion 305B.

Figure 8A:
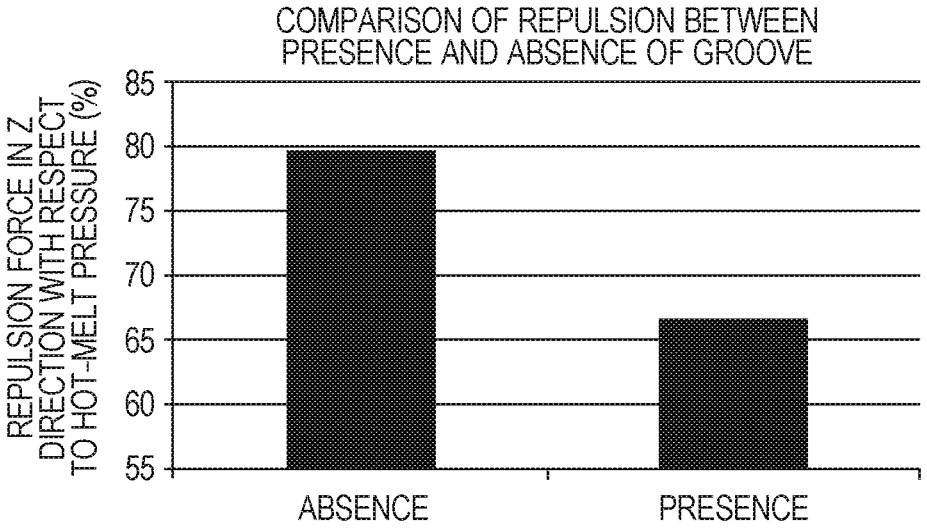
FIG. 8A is a graph for showing a comparison of a repulsion force of the sealing member in accordance with presence and absence of the groove according to the embodiment of the present invention.

FIG. 8A is a graph for showing a difference in the repulsion force of the sealing member in accordance with presence and absence of the groove 306 in the sealing portion 305B. In this graph, there is shown a relationship of the repulsion force in the case where a hot-melt adhesive is used as the sealing member and where the sealing part 305 which has the groove 306 in the sealing portion 305B (indicated as "PRESENCE" in FIG. 8A) and the sealing part 305 which does not have the groove 306 as illustrated in FIG. 7 (indicated as "ABSENCE" in FIG. 8A) are pressed. The vertical axis of FIG. 8A represents a ratio (unit: %) of the repulsion force in the −Z axis direction from the elastically deformed sealing part 305 with respect to hot-melt pressure when a load (hot-melt pressure of 43 N (unit: Newton)) is exerted on the sealing portion 305A. For the measurement of FIG. 8A, the sealing part 305 of this embodiment (groove 306 having a depth of 1.5 mm and a width of 1.4 mm) is used as the sealing part 305 with presence of the groove. With reference to FIG. 8A, the ratio of the repulsion force from the sealing part 305 in the case of exerting the load (43 N) on the sealing portion 305A is 79.7% (34.3 N) when the groove 306 is absent in the sealing part 305. In the case of the sealing part 305 having the groove 306 in the sealing portion 305B, the ratio of the repulsion force is 66.5% (28.6 N). As compared to the case where the groove 306 is absent, the repulsion force from the sealing part 305 is reduced by about 13.2% (=79.7%−66.5%). In the sealing part 305 with absence of the groove and the sealing part 305 with presence of the groove, the identical shapes of the sealing portions 305A and 305C are employed. Therefore, it can be seen that the difference in the repulsion force shown in FIG. 8A is caused by the presence and absence of the groove 306 in the sealing portion 305B.

Figure 8B:
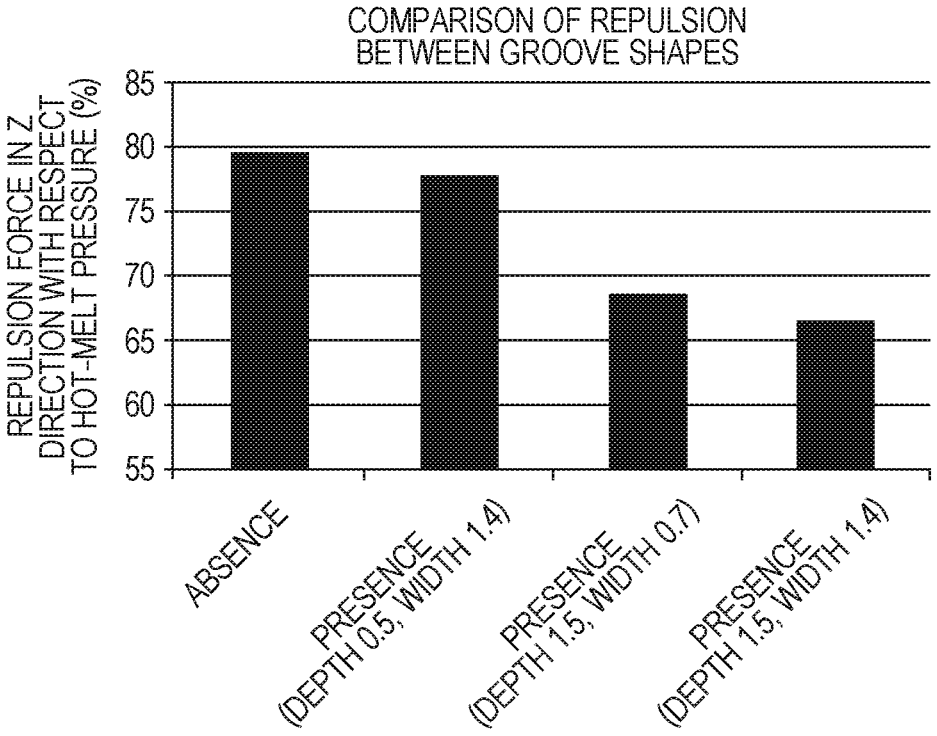
FIG. 8B is a graph for showing a comparison of the repulsion force of the sealing member in accordance with shapes of the groove.

Next, FIG. 8B is a graph for showing the difference in the repulsion force between the sealing part 305 which does not have the groove 306 and three sealing parts 305 which respectively have the grooves 306 of various shapes. The vertical axis of FIG. 8B represents a ratio (unit: %) of the repulsion force in the −Z axis direction from the sealing part 305 with respect to the hot-melt pressure when the load (hot-melt pressure of 43 N) is exerted on the sealing portion 305A. As to the shapes (depth and width) of the groove 306, there are three types: a depth of 0.5 mm and a width of 1.4 mm; a depth of 1.5 mm and a width of 0.7 mm; and a depth of 1.5 mm and a width of 1.4 mm. The repulsion forces with respect to the hot-melt pressure in the cases with the different shapes of the groove 306 shown in FIG. 8B are as follows. Specifically, when the groove 306 is absent, the repulsion force is 79.7% (34.3 N). When the groove 306 has the shape with a depth of 0.5 mm and a width of 1.4 mm, the repulsion force is 77.9% (33.5 N). When the groove 306 has the shape with a depth of 1.5 mm and a width of 0.7 mm, the repulsion force is 68.7% (29.5 N). When the groove 306 has the shape with a depth of 1.5 mm and a width of 1.4 mm, the repulsion force is 66.5% (28.6 N).

As can be seen from the graph of FIG. 8B, when comparison is made between the case where the groove 306 has the shape with a depth of 1.5 mm and a width of 0.7 mm and the case where the groove 306 has the shape with a depth of 1.5 mm and a width of 1.4 mm, the width of the groove 306 is reduced to a half, but the ratios of the repulsion force are 68.7% and 66.5%, which exhibit insignificant difference. Therefore, it can be considered that the sizes in the width of the groove 306 do not have influence on reduction of the repulsion force unless the width (opening) of the groove 306 is squeezed (closed) by the repulsion force when the sealing part 305 is deformed by pressing from the optical box 219. Thus, when the nominal entry amount of the optical box 219 with respect to the sealing part 305 and the width of the groove 306 satisfy the following relationship, the repulsion force from the sealing part 305 can be reduced. Specifically, when the width of the groove 306 is larger than the nominal entry amount which is a designed biting amount (hatched portion in FIG. 6) of the surface 219*b* of the optical box 219 in FIG. 6 with respect to the convex-shaped portion 309 of the sealing portion 305A (nominal entry amount<width of the groove 306), the repulsion force can be reduced. In this embodiment, the nominal entry amount of the optical box 219 with respect to the sealing part 305 in FIG. 6 is 1.1 mm, and the width of the groove 306 is 1.4 mm.

As can be seen from the graph of FIG. 8B, when comparison is made between the case where the groove 306 has the shape with a depth of 0.5 mm and a width of 1.4 mm and the case where the groove 306 has the shape with a depth of 1.5 mm and a width of 1.4 mm, the ratios of the repulsion force are 77.9% and 66.5%. The both grooves 306 have a width of 1.4 mm. However, as the depth changes from 0.5 mm to 1.5 mm, the ratio of the repulsion force changes from 77.9% to 66.5%, and hence the repulsion force is reduced by 11.4% (=77.9%−66.5%). The depth of the groove 306 is associated with the elastic deformation amount (volume relief amount) due to the pressing from the optical box 219. Therefore, as the depth of the groove 306 becomes larger, the volume relief amount also becomes larger (can be increased), and hence the effect of reducing the amount of repulsion from the sealing part 305 is increased. Therefore, setting the depth of the groove 306 in the sealing portion 305B to be as deep (large) as possible within the range which satisfies the molding conditions for the sealing part 305 can increase the effect of reducing the repulsion force. With this, fatigue degradation of the sealing member can be prevented, and hence formation of the gap between the sealing part 305 and the upper cover 301 can be prevented, thereby leading to improvement in the sealability.

[Position of Groove]

When the upper cover 301 is mounted on the optical box 219, the sealing part 305 illustrated in FIG. 4 eliminates the gap between the upper cover 301 and the optical box 219, and seals the inside of the optical box 219 to be isolated from the outside. For that purpose, the sealing part 305 is molded so as to extend around an outer periphery of the upper cover 301. In the aim of suppressing the repulsion force at a location where a larger repulsion force is exerted from the sealing part 305 with respect to the upper cover 301, the groove 306 is formed at a location where the optical box 219 is brought into press contact with the sealing part 305 with a large force. The location where the larger repulsion force is exerted from the sealing part 305 due to the press contact of the optical box 219 with a large force on the sealing part 305 is, in this embodiment, a periphery (vicinity) of a location where the optical box 219 and the upper cover 301 are fixed by the snap-fit parts 304 or through fastening by screws. The protrusions 311 (FIG. 3B) of the optical box 219 formed at positions corresponding to the snap-fit parts 304 are brought into engagement with the snap-fit parts 304 so that the upper cover 301 is mounted on the optical box 219. In addition to the snap-fit parts 304, the optical box 219 and the upper cover 301 are fastened by screws to improve the degree of sealing. At the locations of being fixed by the snap-fit parts 304, or at the locations of being fastened by screws, a pressing force of the optical box 219 with respect to the sealing part 305 of the upper cover 301 becomes larger as compared to other locations. As a result, the repulsion force of the sealing part 305 with respect to the upper cover 301 also becomes larger. Therefore, the groove 306 is formed in a periphery of the locations where the upper cover 301 and the optical box 219 are fixed, thereby achieving the effect of reducing the repulsion force with respect to the upper cover 301.

As illustrated in FIG. 5, the groove 306 is formed in the sealing portion 305B located on an inner side of the optical box 219 with respect to the sealing portion 305A. The snap-fit parts 304 provided on the upper cover 301 are basically arranged on an outer side with respect to the sealing part 305. The protrusions 311 of the optical box 219 and the snap-fit parts 304 of the upper cover 301 are brought into engagement with each other, and hence the upper cover 301 is mounted on the optical box 219. At this time, the snap-fit parts 304 serve as support points, and the sealing portion 305A serves as a power point to be squeezed (pressed) by the optical box 219. Then, the repulsion force from the sealing part 305 to be exerted on the upper cover 301 becomes larger, in view of moment of force, on the inner side of the optical box 219 located away (separated) from the snap-fit parts 304 than on the outer side of the optical box 219 located close to the snap-fit parts 304 serving as the support points. Specifically, in the case with this direction of force, when the groove 306 is formed in the sealing portion 305B on the inner side of the optical box 219 with respect to the sealing portion 305A, the repulsion force in the −Z axis direction is dissipated in the X axis direction while the force in the X axis direction is exerted in the direction toward the inner side of the upper cover 301, that is, the −X axis direction. As compared to the case where the force in the X axis direction is exerted toward the outer side (+X axis direction), the repulsion force toward the inner side (−X axis direction) has less influence on the deformation amount of the sealing portion 305A in view of the relationship of the distance from the snap-fit parts 304 as the support points. Therefore, forming the groove 306 on the inner side of the optical box 219 with respect to the sealing portion 305A reduces the repulsion force on the upper cover 301, thereby being capable of preventing degradation in the degree of sealing of the optical box 219 due to the deformation of the upper cover 301.

The groove 306 is formed in a periphery (vicinity) of each of the snap-fit parts 304 or screw-fastened portions which are locations where the upper cover 301 and the optical box 219 are fixed. In this embodiment, when the groove 306 is formed in a periphery of the snap-fit part 304, a length of the groove 306 in the Y axis direction (length in the longitudinal direction) is set to be longer by about 1 mm from each of both ends of the snap-fit part 304. Similarly, a length of the groove 306 in the Y axis direction formed in the vicinity of the screw-fastened portion is also set to be larger than a diameter of a screw by about 1 mm. Moreover, the groove 306 may be formed, for example, in an entire periphery of the sealing part 305, rather than in accordance with the locations where the upper cover 301 and the optical box 219 are fixed, to thereby reduce the repulsion force with respect to the upper cover 301. In this case, the repulsion force in the vicinity of the location where the upper cover 301 and the optical box 219 are fixed can be reduced, and a small amount of repulsion force generated at other locations can also be reduced. Whether to form the groove 306 partially in accordance with the fixed locations or entirely in the sealing part 305 may be selected in accordance with the configuration of the upper cover 301 or moldability of a molding member for use in formation of the sealing part 305.

As described above, according to this embodiment, degradation in the degree of sealing of the optical box due to deformation of the upper cover can be prevented with a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-161970, filed Aug. 19, 2015, which is hereby incorporated by reference herein in its entirety.

What is claimed is:

1. A light scanning apparatus, comprising:

a light source configured to emit a light beam;

a rotary polygon mirror configured to deflect the light beam emitted from the light source so as to scan a photosensitive member with the light beam;

an optical member configured to guide the light beam deflected by the rotary polygon mirror to the photosensitive member;

an optical box on which the light source is mounted and configured to contain the rotary polygon mirror and the optical member;

a cover configured to cover an opening of the optical box;

a fixation unit configured to fix the cover on the optical box; and a dust-proof member which is molded on the cover so as to prevent dust from entering into the optical box and which is sandwiched between the cover fixed on the optical box by the fixation unit and a side wall of the optical box, wherein the dust-proof member includes an abutment portion against which a top of the side wall abuts, and a groove which is formed along the abutment portion to absorb deformation amount of the dust-proof member to be deformed by abutting the top of the side wall against the abutment portion, and wherein the groove is recessed from a surface to be opposed to the top of the side wall in a direction parallel to a rotation axis of the rotary polygon mirror.

2. A light scanning apparatus according to claim 1, wherein the groove is located closer to a center of the cover than the abutment portion.

3. A light scanning apparatus according to claim 1, wherein a length of the groove in a transverse direction of the groove is larger than a biting depth of the side wall of the optical box into the dust-proof member when the cover is fixed on the optical box.

4. A light scanning apparatus according to claim 1, wherein a length of the groove in a longitudinal direction of the groove is longer than a length of the fixation unit in the longitudinal direction of the fixation unit.

5. A light scanning apparatus according to claim 1, wherein the groove is provided at a position opposed to the fixation unit along a longitudinal direction of the fixation unit.

6. A light scanning apparatus according to claim 1, wherein the groove is provided along an entire periphery of the cover.

7. A light scanning apparatus according to claim 1, wherein the fixation unit is a snap-fit part.

8. A light scanning apparatus according to claim 1, wherein the fixation unit is a screw.

9. A light scanning apparatus according to claim 1, wherein, on a side opposed to the optical box, the abutment portion of the dust-proof member includes:

two convex portions brought into abutment against the side wall of the optical box opposed to the dust-proof member; and a concave portion provided between the two convex portions and separated from the side wall.

10. A light scanning apparatus according to claim 1, wherein the abutment portion on the side where the fixation unit is provided has an inclined surface configured to guide the side wall to the abutment portion.

11. A light scanning apparatus according to claim 1, wherein the dust-proof member is formed to be integrated with the cover, and is elastically deformed by abutment against the side wall.

* * * * *